US010682541B2

(12) United States Patent
Bothfeld et al.

(10) Patent No.: US 10,682,541 B2
(45) Date of Patent: Jun. 16, 2020

(54) NECK STRENGTHENING APPARATUS

(71) Applicants: Nate Bothfeld, Stoughton, WI (US); Chris Hart, Edgerton, WI (US)

(72) Inventors: Nate Bothfeld, Stoughton, WI (US); Chris Hart, Edgerton, WI (US)

( * ) Notice: Subject to any disclaimer, the term of this patent is extended or adjusted under 35 U.S.C. 154(b) by 81 days.

(21) Appl. No.: 16/034,197

(22) Filed: Jul. 12, 2018

(65) Prior Publication Data

US 2018/0318634 A1 Nov. 8, 2018

(51) Int. Cl.

| | |
|---|---|
| ***A63B 21/065*** | (2006.01) |
| ***A63B 21/00*** | (2006.01) |
| ***A63B 23/025*** | (2006.01) |
| ***A63B 71/10*** | (2006.01) |
| *A42B 3/00* | (2006.01) |

(52) U.S. Cl.

CPC ..... *A63B 21/065* (2013.01); *A63B 21/4003* (2015.10); *A63B 23/025* (2013.01); *A63B 71/10* (2013.01); *A42B 3/00* (2013.01)

(58) Field of Classification Search

CPC ..... A42B 3/00; A63B 21/065; A63B 21/4003; A63B 23/025; A63B 71/10

See application file for complete search history.

(56) References Cited

U.S. PATENT DOCUMENTS

| | | | | |
|---|---|---|---|---|
| 1,047,212 | A * | 12/1912 | Hamilton | A63B 21/06 482/105 |
| 4,339,124 | A * | 7/1982 | Vogler | A63B 23/025 482/10 |
| 6,000,066 | A * | 12/1999 | Williams | A63B 21/065 2/209.13 |
| 9,211,438 | B2 * | 12/2015 | Versteegh | A63B 21/00065 |
| 10,328,304 | B2 * | 6/2019 | Versteegh | A61B 5/1121 |
| 2003/0073549 | A1 * | 4/2003 | Hatch | A63B 21/0601 482/92 |

* cited by examiner

*Primary Examiner* — Megan Anderson

(74) *Attorney, Agent, or Firm* — Barry Choobin; Patent 360

(57) ABSTRACT

The present invention discloses a neck strengthening apparatus adaptable to provide physical conditioning and therapeutic benefits. The neck strengthening apparatus comprises a headgear that employing a weight member to provide a predetermined mechanical load to user's neck and spine. The headgear with weight member could be used to exercise the neck as well as to reduce the incidents and severity of concussions and other injuries. Various fastener members are used to detachably fasten the weight member to the anterior or forehead area of the headgear. The weight member could be fastened at a temporo-mandibular joint (TMJ) of the headgear. The neck strengthening apparatus can effectively strengthening and conditioning the user's neck muscles. The apparatus is configured to target on the neck muscles effectively during exercises and in practice sessions.

10 Claims, 13 Drawing Sheets

NECK STRENGTHENING APPARATUS

BACKGROUND OF THE INVENTION

A. Technical Field

The present invention generally relates to a neck muscle strengthening apparatus adaptable to provide physical conditioning and therapeutic benefits. More particular, the present invention is directed to a headgear employing weights to provide a predetermined mechanical load to a user neck and spine to exercise the neck as well as to reduce the incidents and severity of concussions and other injuries.

B. Description of Related Art

The neck is one of the body parts most susceptible to sports-related injuries. Strong, well-developed neck muscles can help protect an athlete's neck and spine against injury, especially in sports such as football, hockey, lacrosse and other related sports.

Currently, there are various known devices for strengthening the neck muscles. Many of these devices require cumbersome equipment and/or uncomfortable harnessing for the head. The harnesses are attached to various types of resistance, such as weights or springs. Neck strengthening could be completed by using various modes of resistances including accommodating resistance, isotonic resistance and isometric resistance.

Known apparatus and methods, however, have a variety of shortcomings. For example, accommodating resistance devices such as elastic bands tend to be less effective than isotonic resistance devices at strengthening and hypertrophying muscle tissue. The known devices which place the load almost directly above the longitudinal axis of the spine. This allows for minimal to no resistance moment arm and increases spinal compression force.

Four-way neck machines could be great machines for neck strengthening in that they allow the neck muscles to be trained in multiple planes in a controlled fashion. However, such machines are relatively expensive and, as a result, typically not widely available in various programs. Further, only one person can typically utilize such a machine at a time, which poses logistical issues for strength coaches who have large groups of athletes to train with finite amounts of time.

Isotonic resistance devices such as harness devices, which are problematic and less effective because by design they allow the load to move during completion of repetition. This reduces the resistance moments at targeted muscles and thus is less effective at strengthening.

Accordingly, there is a need to provide a new neck strengthening apparatus that is easy to implement and convenient to use for kids, athletes and users. There is also a need to provide a neck strengthening apparatus that could be removably attached from existing sports headgears with little or no modifications. There is also a need to provide a neck strengthening apparatus which places the weight on the anterior or forehead area of the headgear to effectively strengthening and conditioning the user neck muscles. There is also a need to provide a headgear with a neck strengthening apparatus that could be used for both neck strengthening exercises and for practice sessions. There is also a need to provide a neck strengthening apparatus that can effectively targeted on the neck muscles during exercises and in practice sessions.

SUMMARY OF THE INVENTION

The present invention generally relates to a neck strengthening apparatus adaptable to provide physical conditioning and therapeutic benefits. A headgear or helmet employing weights to provide a predetermined mechanical load to a user neck and spine to exercise the neck as well as to reduce the incidents and severity of concussions and other injuries.

The neck strengthening apparatus comprising a headgear or helmet including an open lower end for receiving a user head and a curved upper portion for contouring to the user head. A weight member is fastened on the anterior or forehead of the headgear. The weight member shaped to conform with an exterior surface of the headgear at a location above and adjacent to the open lower end. The weight member could be detachably fastened to anterior portion of the headgear.

In one embodiment, the weight member is made of at least one of a material comprising iron, steel and cast iron. In other embodiment, the weight member is made of at least one of a material comprising plastic, vinyl, polyvinyl chloride and rubber.

In various embodiments, the weight member is made of in a rectangular shape or a square shape or a concave shape to fit on the contour shape of the headgear. In one embodiment, the weight member could be placed at an anterior or forehead area of the headgear. In other embodiment, the weight member could be placed at a temporo-mandibular joint (TMJ) of the headgear.

In various embodiments, the weight member positions, by way of its attachment to the headgear provides an appropriate resistance moment arm to allow for effective strengthening and conditioning of the neck muscles.

In one embodiment, the fastener member is formed continuously along with said weight member. In other embodiment, the fastener member integral to the weight member by means of adhesive means. In various embodiments, the fastener member comprises at least any one of a hook type fastener, clamp type fastener, snap clip type fastener, pipe clip type fastener and U-clamp type fastener. In other embodiment, the fastener member could be configured to removably fastened to the headgear and the weight member. In one embodiment, the fastener members allowing the user to alter the weight member on the surface of the headgear.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The embodiments herein will be better understood from the following detailed description with reference to the drawings, in which.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1:
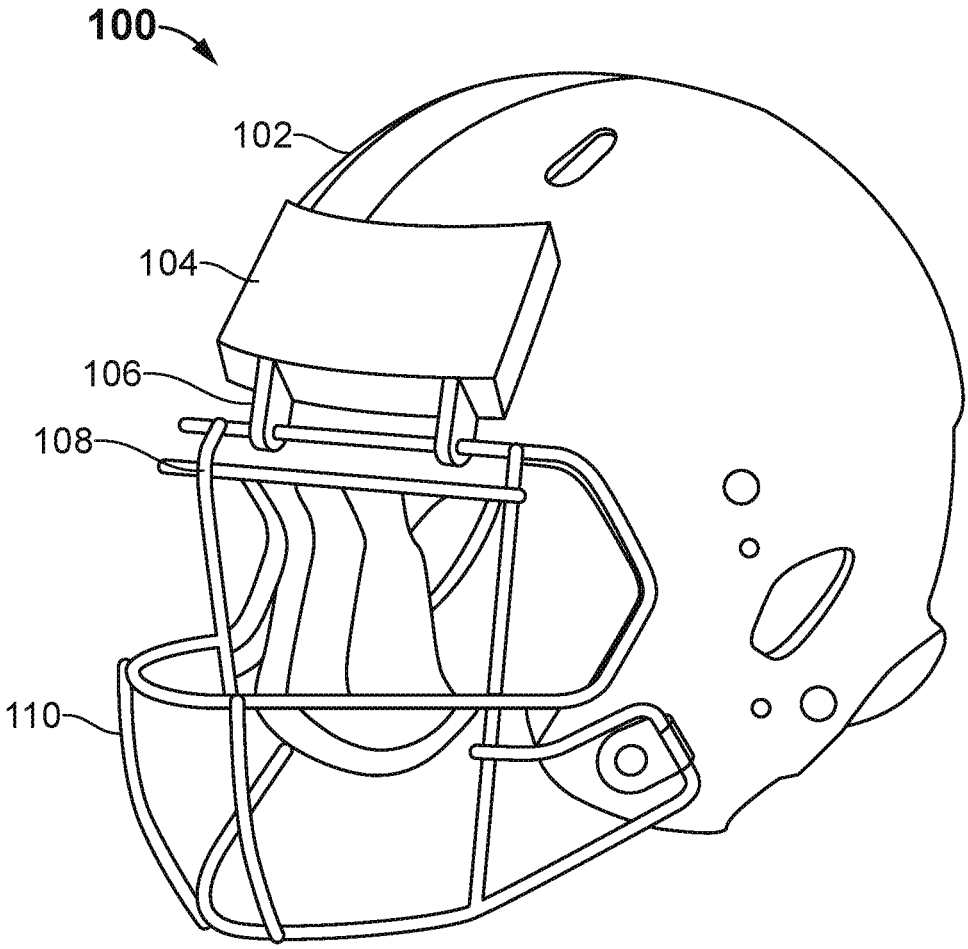
FIG. 1 is a perspective view of a neck strengthening apparatus with a headgear in an embodiment of the present invention.

Referring to FIG. 1, a perspective view of a neck strengthening apparatus with a headgear 100 in an embodiment of the present invention. The neck strengthening apparatus 100 comprises a headgear or helmet 102, a weight member 104, fastener members 106, a plurality of headgear bars 108 and a temporo-mandibular joint (TMJ) 110 of the headgear 102.

In operation, the user can fasten the weight member 104 to the headgear 102 by means of fastener members 106. By wearing the weight mounted headgear and perform different exercises such as side lying cervical rotation, side lying lateral flexion, supine cervical flexion and quadruped cervical extension.

In one embodiment the weight member 104 could be fastened to an anterior or forehead area of the headgear 102. In another embodiment, the weight member 104 could be fastened to the temporo-mandibular joint (TMJ) of the headgear. In another embodiment, the weight member could be comprised in various sizes and weights including but not limited to 2.5, 5, 7.5 and 10 pounds. The weight on the anterior or forehead area and the temporo-mandibular joint (TMJ) of the headgear 102 make effectively strengthening and conditioning the user's neck muscles during neck exercises and also in practice sessions.

Figure 2:
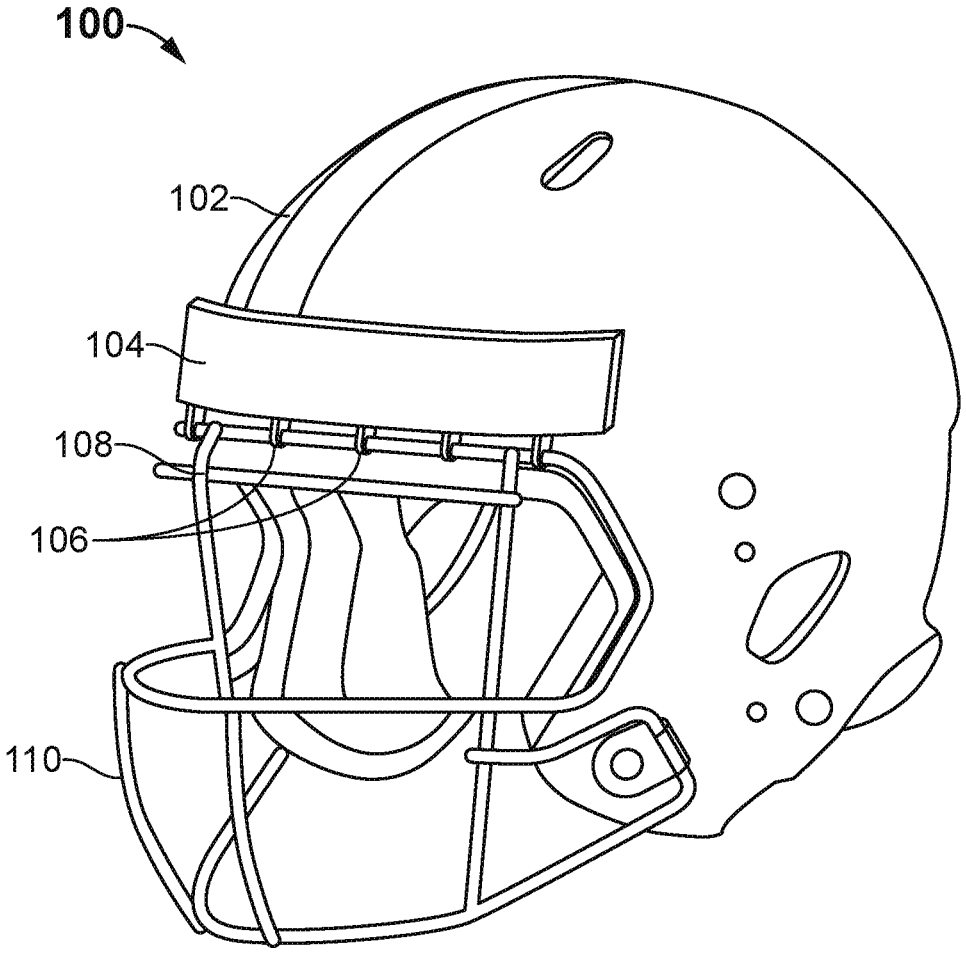
FIG. 2 is a perspective view of the neck strengthening apparatus with the headgear in another embodiment of the present invention.

Referring to FIG. 2, a perspective view of the neck strengthening apparatus with the headgear in another embodiment of the present invention. The weight member 104 is removably fastened or coupled to at least one headgear bar 108 by means of the plurality of fastener members 106, according to another embodiment of the invention. The weight member 104, provides a constant load on the headgear 102.

Figure 3:
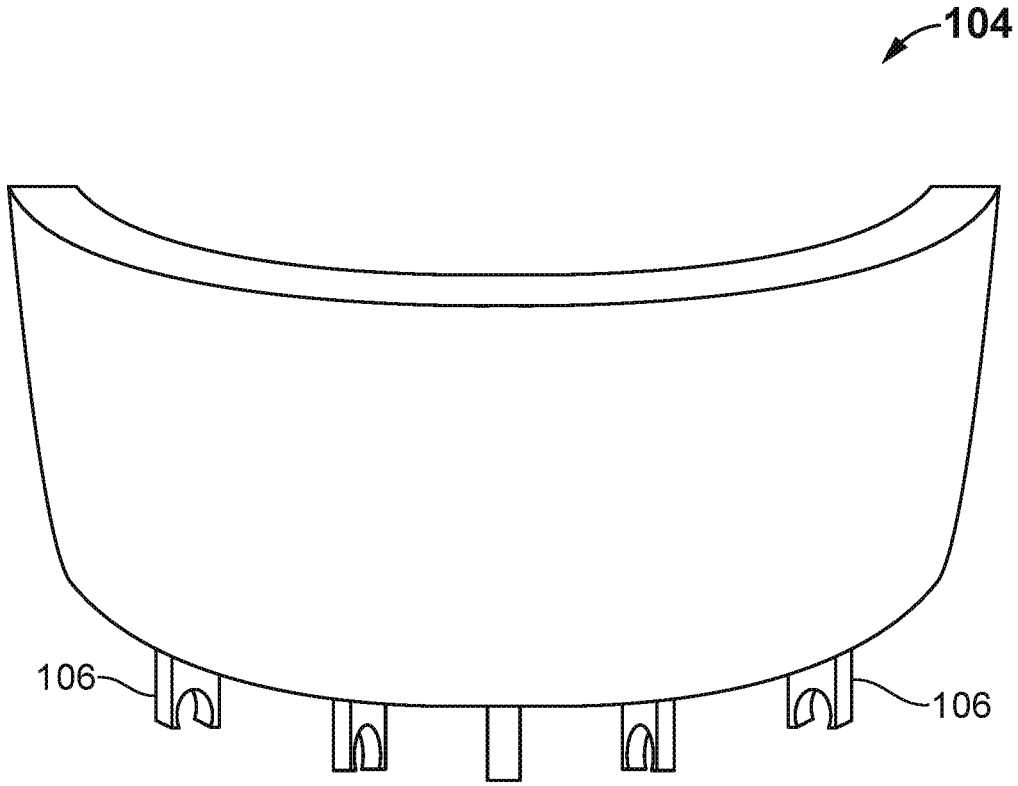
FIG. 3 is a detailed view of the neck strengthening apparatus with the headgear of FIG. 2 in another embodiment of the present invention.

Referring to FIG. 3, a detailed view of the neck strengthening apparatus with the headgear of FIG. 2 in another embodiment of the present invention. The plurality of fastener members 106, could be configured or oriented to take from above the headgear bar to which they are being removably coupled. The plurality of fastener members 106, could be a plurality of pipe clips according to another embodiment of the invention. The pipe clips 106, provides facilitates to the user to removably fastened to the headgear bars 108.

Figure 4:
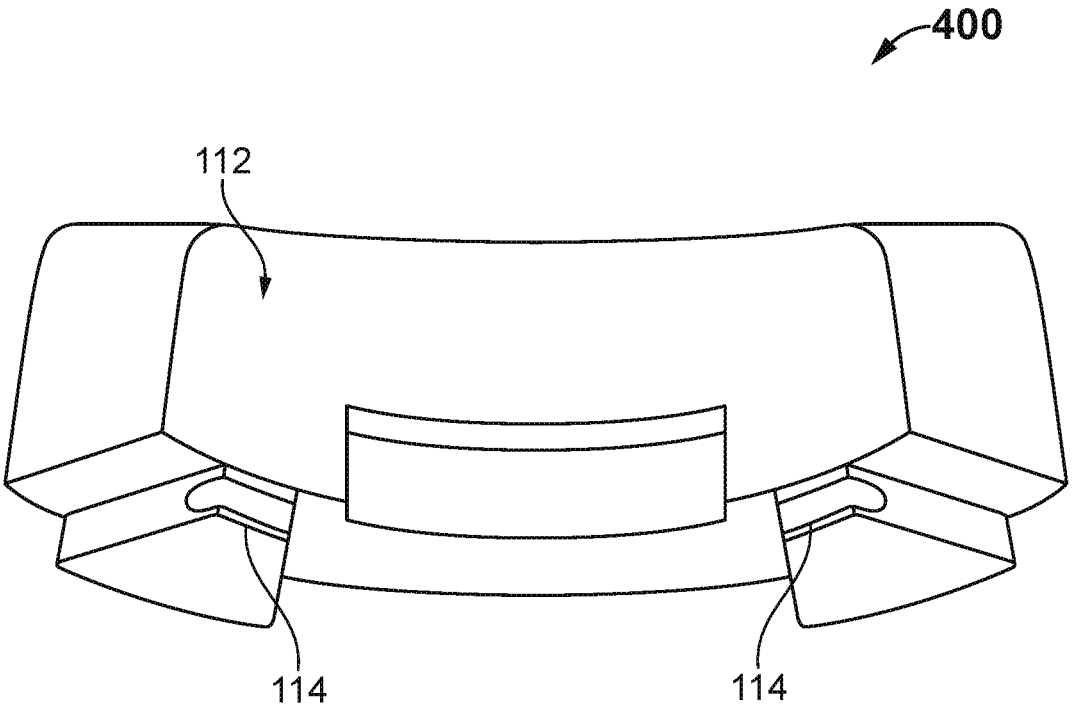
FIG. 4 is a front perspective view of the neck strengthening apparatus in another embodiment of the present invention.

Referring to FIG. 4, a front perspective view of the neck strengthening apparatus 400 in another embodiment of the present invention. The weight member 112, having a surface including a contour shape that adapts to fit on the anterior or forehead area and temporo-mandibular joint (TMJ) of the headgear 102. The weight member 112 comprises fastener members 114 as depicted in FIG. 4. The fastener members 114 are fastened to the weight member 112 by adhesive means such as epoxy adhesive or by fasteners such as screws. The fastener members 114 could be configured or oriented to detachably attached to the headgear bars 108. In another embodiment, the fastener members 114 are integrally disposed with the weight member. 112.

Figure 5:
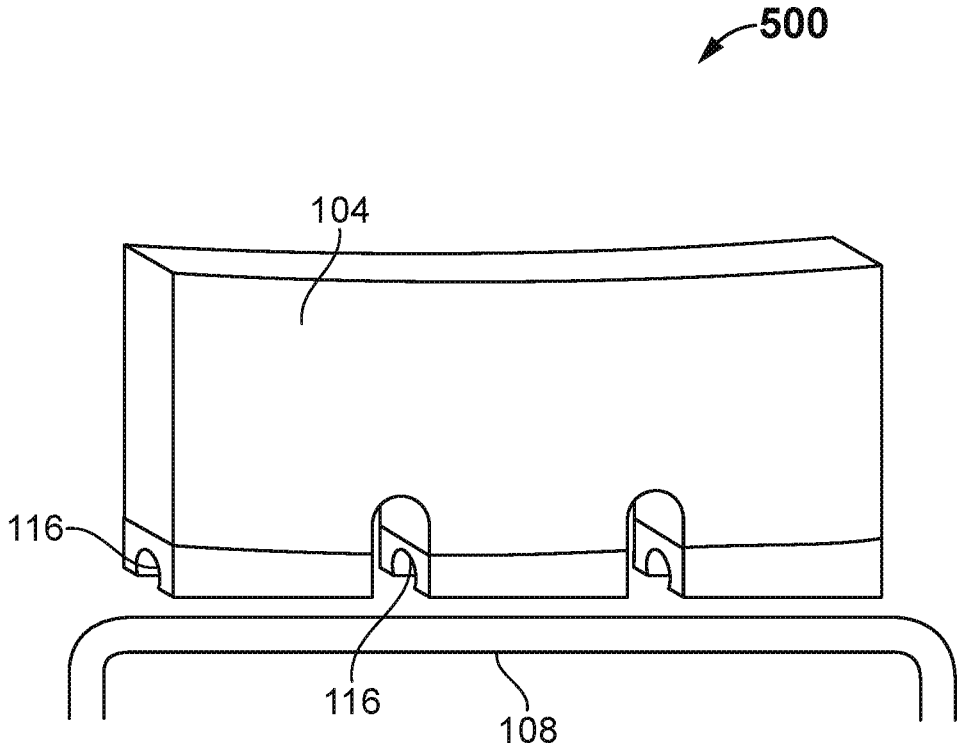
FIG. 5 is a front perspective exploded view of the neck strengthening apparatus and a headgear anterior portion in another embodiment of the present invention.

Referring to FIG. 5, a front perspective exploded view of the neck strengthening apparatus and a headgear anterior portion 500 in another embodiment of the present invention. The weight member 104 comprises the plurality of fastener members 116 according to another embodiment of the invention. The fastener member 116 could be a snap clip, that could be configured or oriented to removably attached to the headgear bars 108. These fastener members 116 are fastened to the weight member 104 by adhesive means such as epoxy adhesive or by fasteners such as screws. In another embodiment, the plurality of fastener members 114 are integrally disposed with the weight member 104.

Figure 6:
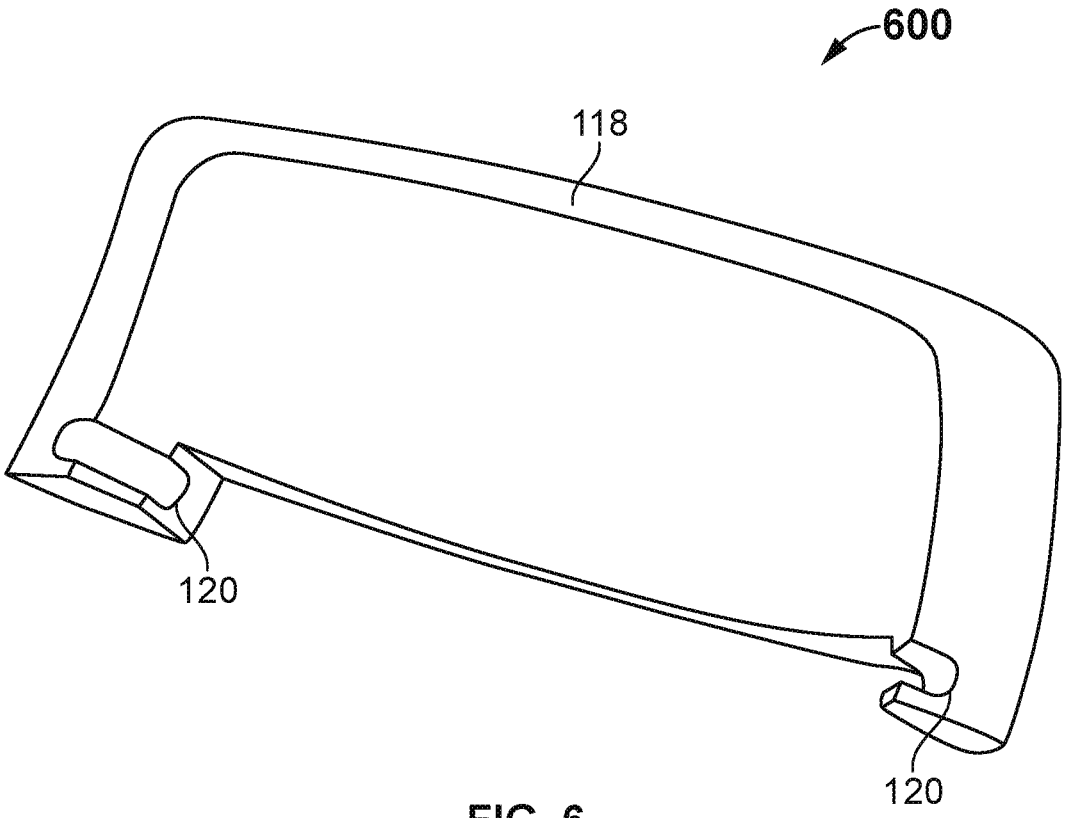
FIG. 6 is a rear perspective view of the neck strengthening apparatus in another embodiment of the present invention.

Referring to FIG. 6, a rear perspective view of the neck strengthening apparatus 600 in another embodiment of the present invention. The weight member 118 comprises the plurality of fastener members 120 according to another embodiment of the invention. The plurality of fastener members 120 are formed continuously along with the weight member 118. In one embodiment the weight member 118 could be fastened at anterior or forehead area of the headgear 102. In another embodiment, the weight member 118 could be placed at temporo-mandibular joint (TMJ) 110 of the headgear 102.

Figure 7:
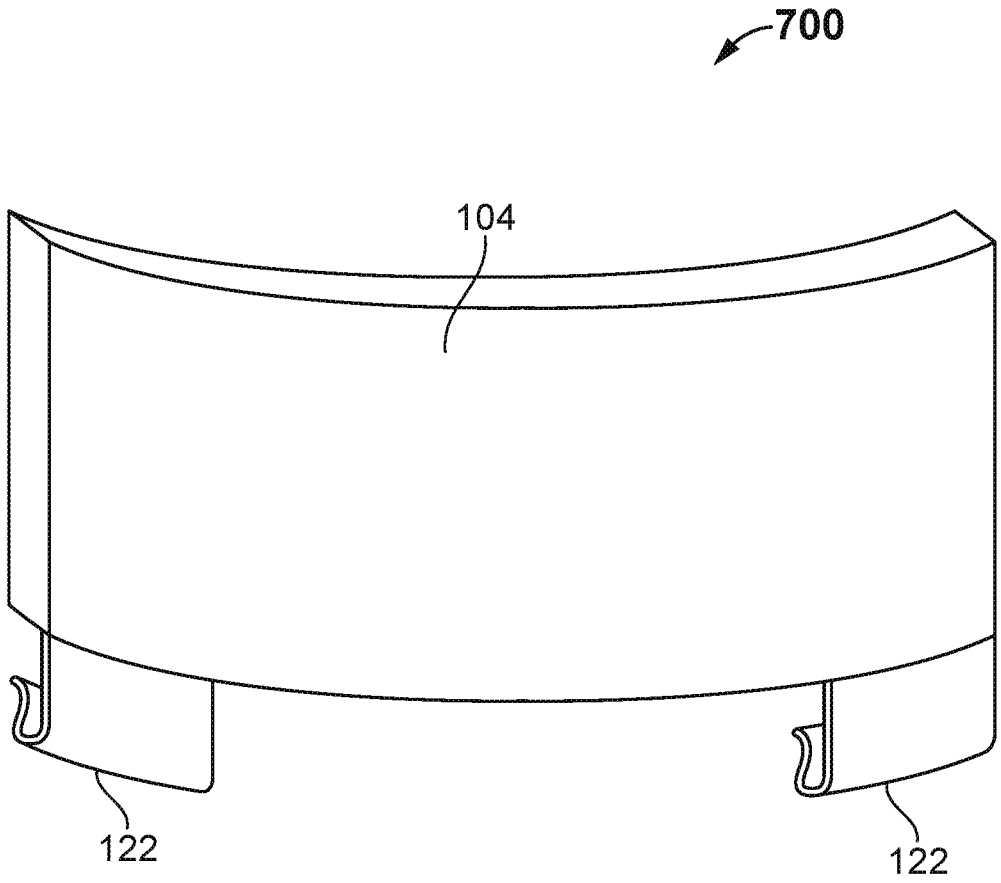
FIG. 7 is a front perspective view of the neck strengthening apparatus in another embodiment of the present invention.

Referring to FIG. 7, a front perspective view of the neck strengthening apparatus 700 in another embodiment of the present invention. The weight member 104 comprises at least two fastener members 122 which are fastened to the weight member 104 by adhesive means such as epoxy adhesive or by fasteners such as screws. The fastener members 122 could be configured or oriented to removably attached to the headgear bars 108 and snap up from below the headgear bars 108. In another embodiment, the fastener members 122 are integrally disposed with the weight member 104.

Figure 8:
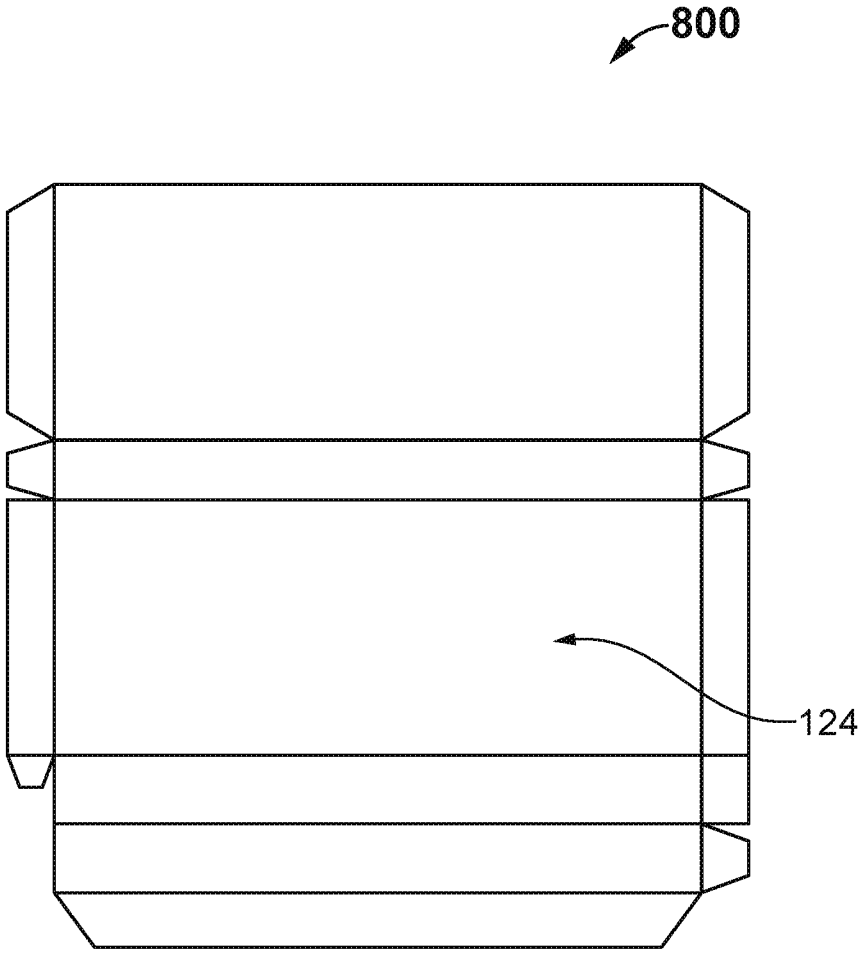
FIG. 8 is a plan view of an unassembled neck strengthening apparatus in another embodiment of the present invention.
Figure 9:
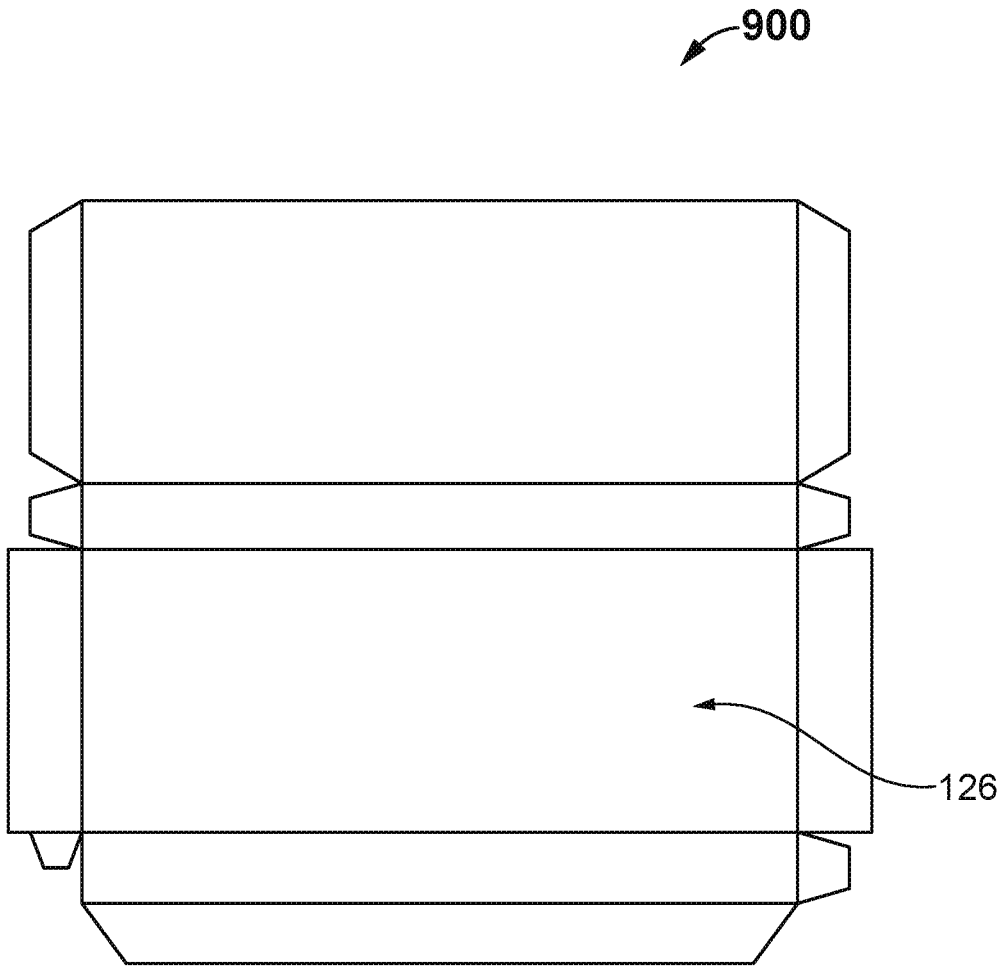
FIG. 9 is a plan view of an unassembled neck strengthening apparatus in another embodiment of the present invention.

Referring to FIG. 8, a plan view of an unassembled neck strengthening apparatus 800 in another embodiment of the present invention. Referring to FIG. 9, a plan view of an unassembled neck strengthening apparatus 900 in another embodiment of the present invention.

Figure 10A:
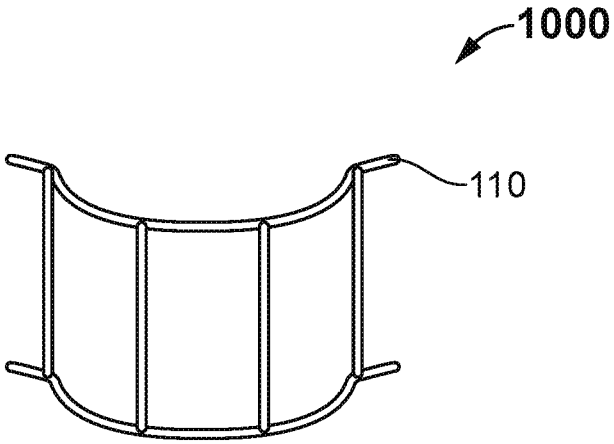
FIG. 10A is a front perspective view of the headgear temporo-mandibular joint in one embodiment of the present invention.

Referring to FIG. 10A, a front perspective view of the headgear temporo-mandibular joint 1000 in an embodiment of the present invention. The headgear 102 comprises the temporo-mandibular joint (TMJ) 110, which is made of various bars as depicted in FIG. 10A. The temporo-mandibular joint (TMJ) could be configured to fasten the weight member 130.

Figure 10B:
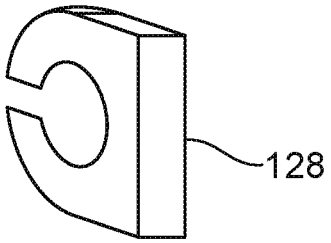
FIG. 10B is a perspective view of the fastener member according to another embodiment of the invention.

Referring to FIG. 10B, a perspective view of a fastener member 128 according to another embodiment of the invention. The fastener member 128 could be a snap clip, which is used to fasten the weight member to the temporo-mandibular joint (TMJ) 110 of the headgear. In one embodiment, the snap clip 128 could be configured to detachably fastened to the temporo-mandibular joint (TMJ) 110 of the headgear.

Figure 10C:
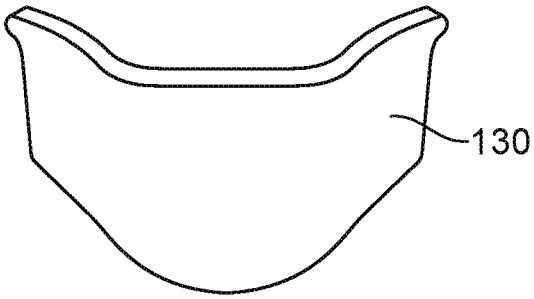
FIG. 10C, is a front perspective view of the weight member according to another embodiment of the invention.

Referring to FIG. 10C, a front perspective view of the weight member 130 according to another embodiment of the invention. The weight member 130 comprises a concave shape and that can adapt to fit on the temporo-mandibular joint (TMJ) 110 of the headgear. In one embodiment, the weight member 130 is made of at least one of a material comprising iron, steel and cast iron. In other embodiment, the weight member is made of at least one of a material comprising plastic, vinyl, polyvinyl chloride and rubber.

Figure 11:
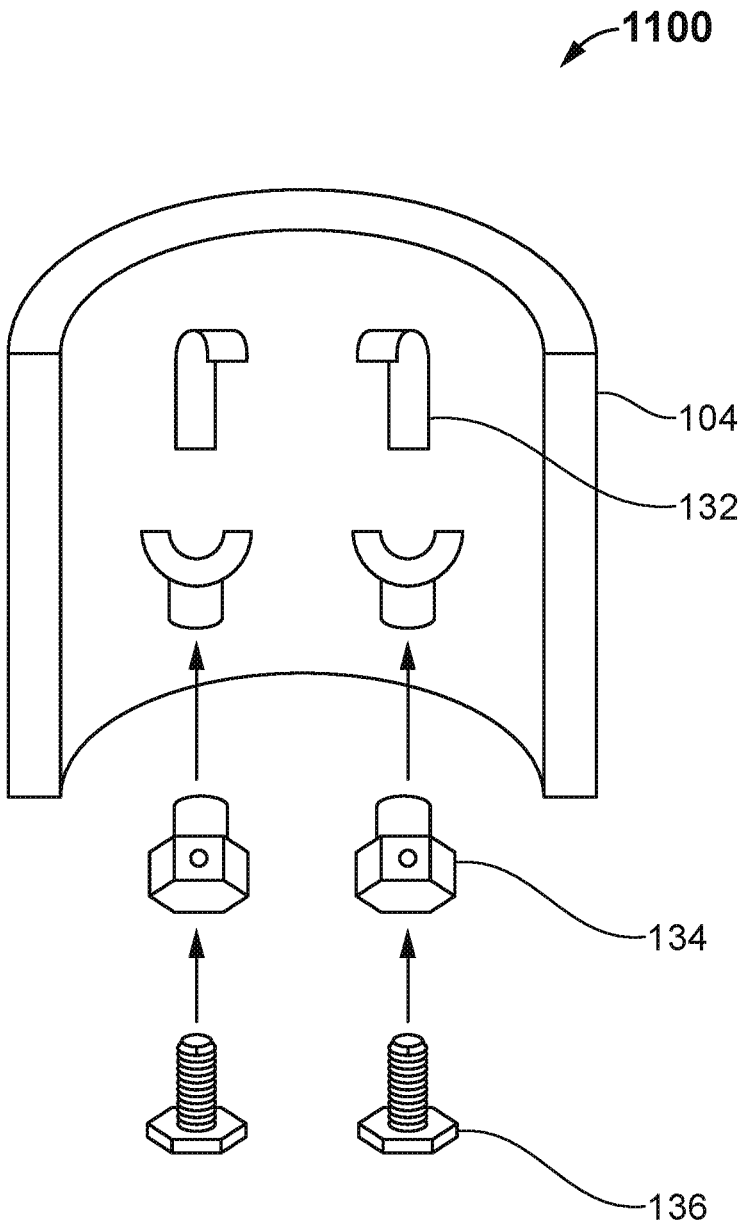
FIG. 11 is an exploded perspective view of a system for coupling a neck strengthening apparatus and the headgear anterior portion in another embodiment of the present invention.

Referring to FIG. 11, an exploded perspective view of a system for coupling a neck strengthening apparatus 1100 in another embodiment of the present invention. The weight member 104 comprises fastener members 132 and adhesive means 134, 136 according to another embodiment of the invention. The fastener members 132 are at least two hooks. The hooks 132 are integral to the weight member 104 by an adhesive means such as an epoxy adhesive. In one embodiment, the hooks 132 and the adhesive means 134, 136 are used to fasten the weight member 104 to the anterior or forehead of the headgear bars 108. In another embodiment, the weight member 104 is fastened to the temporo-mandibular joint (TMJ) 110 of the headgear 102 by means of hooks 132 and the adhesive means 134, 136. In one embodiment, the adhesive means 134, 136 could be a screws and nuts as depicted in FIG. 11. In another embodiment, the weight member 104 is provided with a provision to allow the screws and bolts 134, 136 within it.

Figure 12:
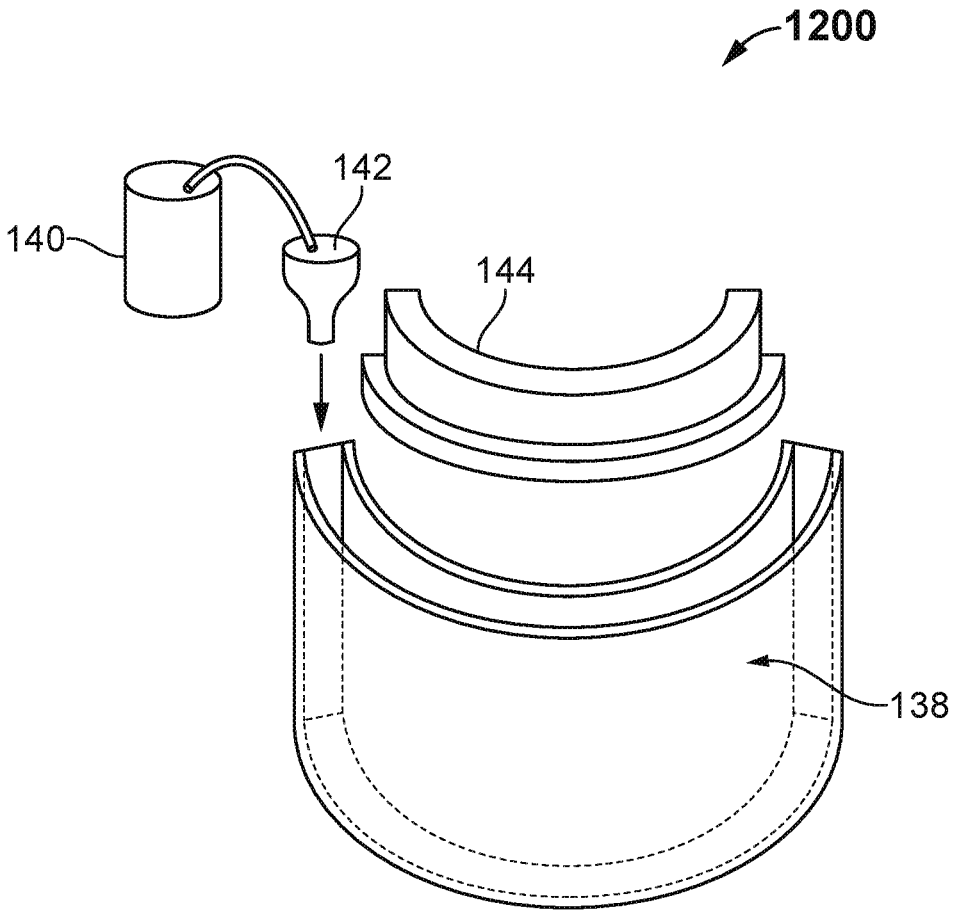
FIG. 12 is a system for making the neck strengthening apparatus in one embodiment of the present invention.

Referring to FIG. 12, a system for making the neck strengthening apparatus 1200 in one embodiment of the present invention. In one embodiment, the system 1200 comprises a container 138, a receptacle with liquid material 140, a filter jet 142 and a top cover 144. The container 138 is filled with the liquid material through the filter jet 142. The filter jet 142 filters the liquid material and transfers the liquid material into the container 138 with a specified speed. When the liquid material reaches the specified limit in the container 138, then the filter jet stops the flow of the liquid material. A top cover 144 is provided to cover the container 138 for certain time. The liquid material transforms to a rigid body such as a weight member with the shape of the container 138.

In one embodiment, the liquid material comprises iron, steel and cast iron. In another embodiment, the liquid material comprises plastic, vinyl, polyvinyl chloride and rubber.

Figure 13:
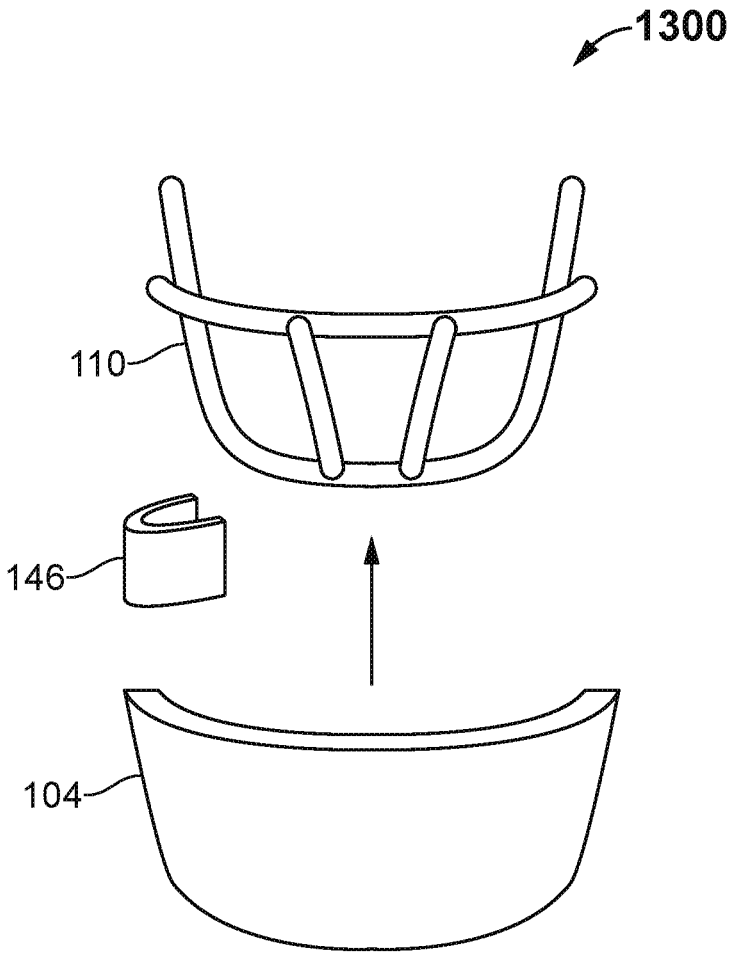
FIG. 13 is an exploded perspective view of the neck strengthening apparatus and the headgear in another embodiment of the invention.

Referring to FIG. 13, an exploded perspective view of the neck strengthening apparatus and the headgear 1300 in another embodiment of the invention. The headgear comprises the temporo-mandibular joint (TMJ) 110 with the plurality of bars. The weight member 104 is fastened to the temporo-mandibular joint (TMJ) 110 of the headgear by means of the fastener members 146. In another embodiment, the fastener member 146 is might be a U-clip. The U-clips 146 are used to fasten the weight member 104 to the temporo-mandibular joint (TMJ) 110. The U-clips 146 could be configured to removably attached to the weight member 104 and the headgear 102.

In another embodiment, the weight member 104 could be fastened on any part of the headgear 102 including ear hole. In another embodiment, any number of different types of fasteners, clips, hooks and clamps for detachably attached to the weight member to headgear may utilized.

The neck strengthening apparatus 100 reduces the risk of the user sustaining cervical spine injuries and concussions by effectively strengthening the neck muscles. The apparatus 100 strengthens the neck muscles of the children, users, and athletes in a safe and optimal manner. The neck strengthening apparatus 100 is cost effective and easily detachably attached to the headgear by means of various fastener members. The neck strengthening apparatus 100 effectively targeted on the neck muscles during exercises and in practice session.

Although a single embodiment of the invention has been illustrated in the accompanying drawings and described in the above detailed description, it will be understood that the invention is not limited to the embodiment developed herein, but is capable of numerous rearrangements, modifications, substitutions of parts and elements without departing from the spirit and scope of the invention.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A neck strengthening apparatus comprising:

a headgear having an open lower end for receiving a user head, a face opening, the face opening configured with a plurality of bars;

a weight member shaped to conform with an exterior surface of the headgear at a location above and adjacent to the open lower end, and a fastener releasably coupled to one or more of the plurality of bars, bars, and coupled to the headgear, wherein the weight member applies a mechanical load to neck muscles of the user, thereby provides effective strengthening and conditioning of the neck muscles.

2. The neck strengthening apparatus of claim 1, wherein said weight member is made of a material selected from a group consisting of iron, steel and cast iron.

3. The neck strengthening apparatus of claim 1, wherein said weight member is made of a material selected from a group consisting of plastic, vinyl, polyvinyl chloride and rubber.

4. The neck strengthening apparatus of claim 1, wherein said weight member is of rectangular shape.

5. The apparatus of claim 1, wherein said weight member is of square shape.

6. The neck strengthening apparatus of claim 1, wherein said weight member is of concave shape.

7. The neck strengthening apparatus of claim 1, wherein said fastener is integrated with the weight member.

8. The apparatus of claim 1, wherein said fastener is disposed to the weight member by means of adhesive means.

9. The neck strengthening apparatus of claim 1, wherein said fastener is selected from a group consisting of clamp type fastener, snap clip type fastener, pipe clip type fastener and U-clamp type fastener.

10. The neck strengthening apparatus of claim 1, wherein said fastener comprises one or more clips, said one or more clips configured to snap fit to the one or more of the plurality of bars.

* * * * *